US006702496B1

(12) United States Patent
Park

(10) Patent No.: US 6,702,496 B1
(45) Date of Patent: Mar. 9, 2004

(54) WRITING PEN WITH A HOLDER

(76) Inventor: Sang Wan Park, #55 Soonae-dong, Bundang-gu, Sungnam-si, Kyunggi-do 463-020 (KR)

( * ) Notice: Subject to any disclaimer, the term of this patent is extended or adjusted under 35 U.S.C. 154(b) by 0 days.

(21) Appl. No.: 10/390,294

(22) Filed: Mar. 17, 2003

(51) Int. Cl.[7] ..... B43K 23/02; A46B 11/00

(52) U.S. Cl. ..... 401/131; 401/48; 401/7; 224/267

(58) Field of Search ..... 401/131, 48, 7, 401/8, 6, 195, 52; 224/267; 24/10 R

(56) References Cited

U.S. PATENT DOCUMENTS 426,321 A * 4/1890 Ramsey ..... 15/443
1,701,057 A * 2/1929 Thatcher ..... 224/221
3,503,546 A * 3/1970 Hunt ..... 224/218
4,148,424 A * 4/1979 Fortenberry ..... 224/218
5,542,588 A * 8/1996 Sison ..... 224/218

* cited by examiner

*Primary Examiner*—David J. Walczak
(74) *Attorney, Agent, or Firm*—Porter, Wright, Morris & Arthur, LLP

(57) ABSTRACT

A writing pen with a holder attached thereto which is held by a user's hand and enables the user to write conveniently while operating a keyboard of a computer, and it comprises a holder (10) having a contact part (11) in the center thereof to be in contact with a palm of a hand on one side; connecting parts (12) extending from both ends of the contact part (11) to be connected with each other on the back of the hand; a spherical groove for pivoting (13) formed at one end of the other side of the contact part (11); and locking pieces (14) formed at the other end of the other side of the contact part (11), and a writing pen (20) having a body (23); a fitting ball (21) formed at one end of the body (23) to be pivotable in the spherical groove (13); and a writing member (22) formed at the other end of the body (23).

3 Claims, 2 Drawing Sheets

WRITING PEN WITH A HOLDER

FIELD OF THE INVENTION

The present invention relates to a writing pen with a holder, and more particularly to a writing pen with a holder attached thereto which is held by a user's hand and enables the user to write conveniently while operating a keyboard of a computer, thus improving working efficiency.

BACKGROUND OF THE INVENTION

Recently, more and more work is done by using computers and such computer work shows a tendency to increase rapidly. Also, it is frequent to write something with a writing pen while operating a computer.

When a computer worker has to use a writing pen to take notes continually and repeatedly while keyboarding, as he cannot keyboard with holding the writing pen in one hand, he has to place the writing pen near the keyboard, bite the pen with a mouth or hang the pen around an ear, and every time he needs to take notes, he has to move his hands from the keyboard and hold up the pen with one hand to write on paper.

That is, as the user cannot hold the pen in one hand while operating a keyboard, if the pen is needed, he has to remove his hand from the keyboard to pick up the pen, and after taking notes, he has to return the pen to its original place. Then, the user must repeat this procedure whenever he needs to take notes, and this causes inconveniences to the user.

Therefore, if a writing pen with a holder which enables the user to write conveniently while operating a keyboard of a computer is developed, it will offer the user much convenience and working efficiency will be significantly improved.

SUMMARY OF THE INVENTION

Accordingly, an object of the present invention is to provide a writing pen with a holder attached thereto, which is held by a user's hand and enables the user to write conveniently while operating a keyboard of a computer, thus improving working efficiency.

Another object of the present invention is to provide a writing pen with a holder attached thereto, which has an improved product credibility and an enhanced commercial applicability.

In order to achieve the above objects, a writing pen with a holder according to the present invention comprises:

- a holder of a predetermined width and length, having a contact part in the center thereof to be in contact with a palm of a hand on one side; connecting parts extending from both ends of the contact part to be connected with each other on the back of the hand; a spherical groove for pivoting formed at one end of the other side of the contact part; and locking pieces formed at the other end of the other side of the contact part, and
- a writing pen having a body; a fitting ball formed at one end of the body to be pivotable in the spherical groove; and a writing member formed at the other end of the body.

Accordingly, when it is necessary to take notes simultaneously with doing another work, for example, with operating a keyboard of a computer, the user can hold the writing pen with a holder according to the present invention in his hand, by attaching the contact part of the holder to the user's palm and fitting the connecting parts to each other on the back of the hand. Thus, when operating the keyboard, the writing pen having the fitting ball at one end of the body is fitted into the spherical groove for pivoting and also fitted to the locking pieces provided on one side of the contact part other than the side to which the user's palm is attached. Then, in taking notes, the writing pen is pulled out from the locking pieces of the holder and the fitting ball is pivoted in the spherical groove. The body of the writing pen is then held by the user to serve to take notes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention, wherein.

DETAILED DESCRIPTION OF THE PREFERRED EMBODIMENTS

Figure 1:
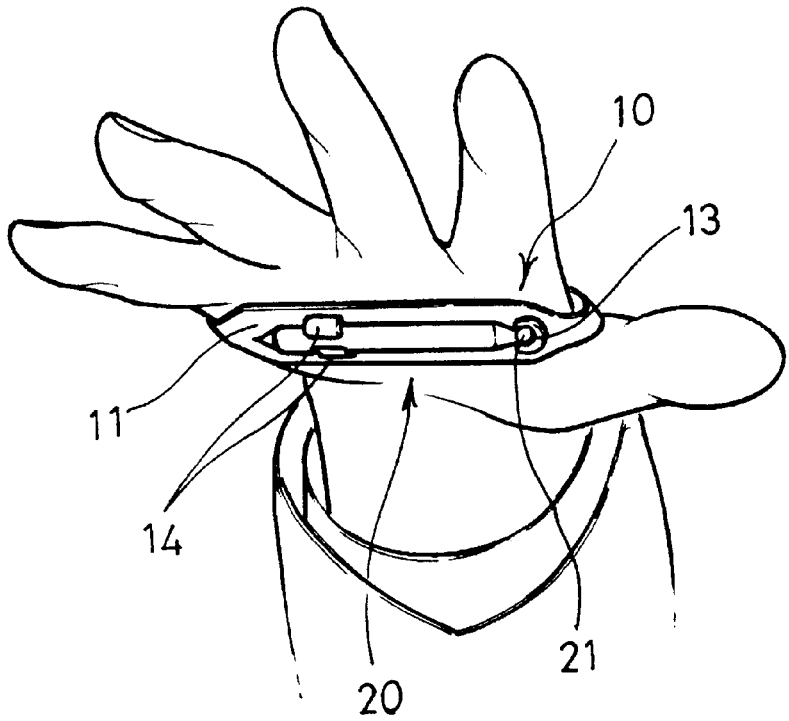
FIG. 1 is a perspective view showing the state where a writing pen with a holder is mounted in the user's hand.

Reference will now be made in detail to preferred embodiments of the present invention in conjunction with the accompanying drawings.

A writing pen with a holder according to the present invention comprises:

- a holder (10) of a predetermined width and length, having a contact part (11) in the center thereof to be in contact with a palm of a hand on one side; connecting parts (12) extending from both ends of the contact part (11) to be connected with each other on the back of the hand; a spherical groove for pivoting (13) formed at one end of the other side of the contact part (11); and locking pieces (14) formed at the other end of the other side of the contact part (11), and
- a writing pen (20) having a body (23); a fitting ball (21) formed at one end of the body (23) to be pivotable in the spherical groove (13); and a writing member (22) formed at the other end of the body (23).

As shown in FIGS. 1 to 4, the writing pen with the holder comprises the holder (10) of a predetermined width and length, and the holder (10) includes the contact part (11) in the center thereof, which faces the palm of the hand on one side.

As shown in FIG. 1, it is preferable that the contact part (11) of the holder (10) is formed in an appropriate size to be in an easy and comfortable contact with the palm of the hand.

It is preferable that the contact part (11) is set in an appropriate width and thickness so that it does not disturb the operation of the keyboard and the user can comfortably operate the keyboard. Also, it is preferable that the contact part (11) is slightly broader in width than the writing pen (20) which is fitted to the holder (10) by the locking pieces (14).

From both ends of the contact part (11), the connecting parts (12) are extended to be fitted to each other on the back of the hand.

Figure 2:
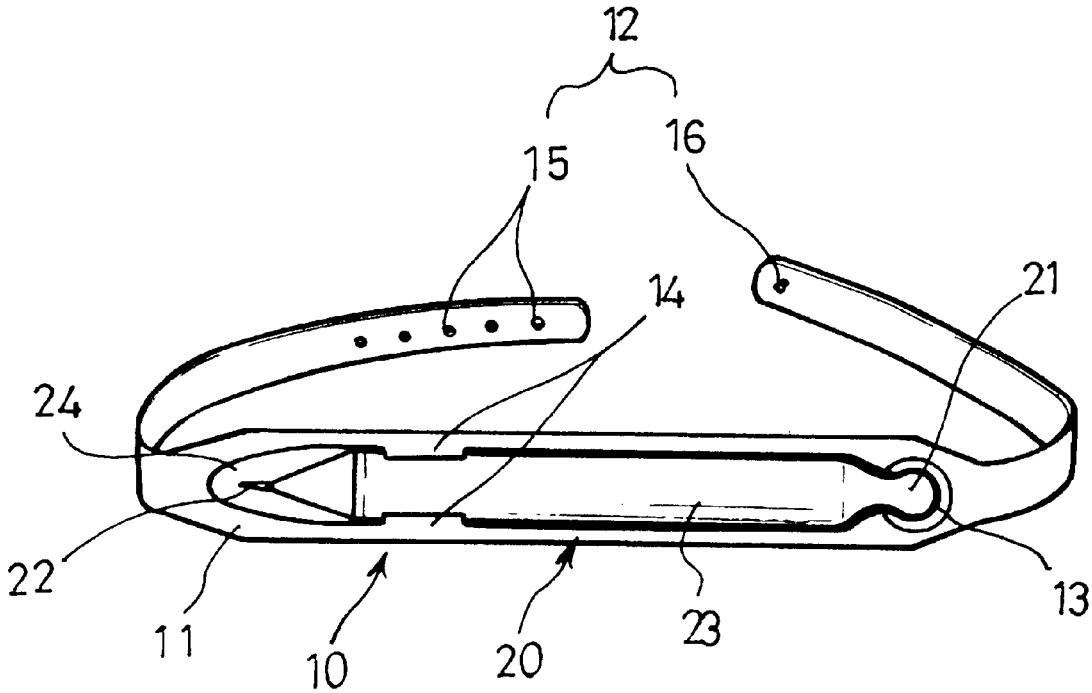
FIG. 2 is a perspective view showing the construction of a writing pen with a holder according to the present invention.
Figure 4:
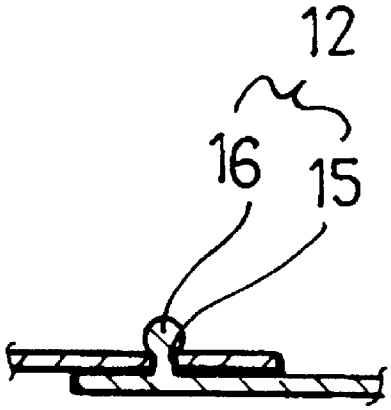
FIG. 4 is an enlarged sectional view of connecting parts of a holder which are connected with each other at both ends of the holder.

As shown in FIGS. 2 and 4, one of the connecting parts (12) has a plurality of fitting holes (15) arranged in a predetermined interval at the end, and the other connecting part (12) includes a protrusion (16) at the end thereof to be fitted into one of the fitting holes (15).

As the protrusion (16) is formed in the shape of a sphere, it is fitted into one of the fitting holes (15) such that the length of the holder (10) can be adjusted as the user wishes.

Alternatively, the connecting parts (12) can be formed in Velcro tapes, snap hooks and the like, and these are also included in the present invention.

On one side of the contact part (11) on the opposite side of the palm of the hand, the spherical groove for pivoting (13) is formed at one end and a pair of the locking pieces (14) are formed at the other end.

The spherical groove (13) allows the writing pen (20) to pivot therein in a state where one end of the writing pen (20) is inserted and fitted into the groove (13).

Figure 3:
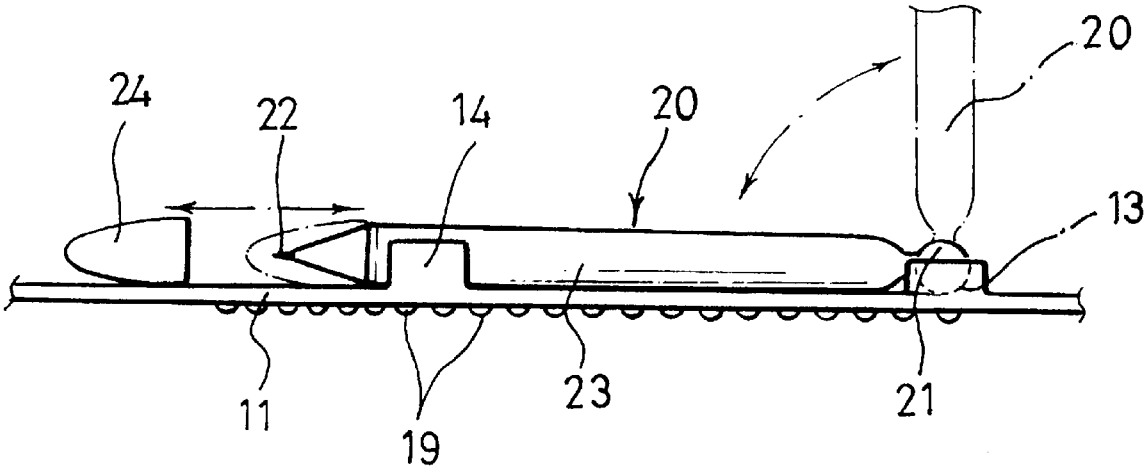
FIG. 3 is an enlarged front view of a part of a writing pen with a holder which shows the writing pen pivoted in the spherical groove.

As shown in FIG. 3, the groove for pivoting (13) is formed in the shape of a ball inwardly and the fitting ball (21) of the writing pen (20) is fitted into the groove (13). As the groove for pivoting (13) has its inside surface in contact with the fitting ball (21) covering more than a half of the fitting ball (21), the fitting ball (21) is stably fitted to the groove for pivoting (13) and the writing pen (20) having the fitting ball (21) at one end is pivoted therein.

As shown in FIGS. 2 and 3, the locking pieces (14) are provided on the other end on one side of the contact part (11) and they are formed in the shape of arc inwardly to be tensioned. They are separated each other by a predetermined interval to have free space in its center. If the body (23) of the writing pen (20) is pressed by force against the locking pieces (14) with the fitting ball (21) being fitted into the spherical groove (13), the free space between the locking pieces (14) becomes wider with tension, so that the body (23) of the writing pen (20) can be fitted thereto.

It is preferable that the locking pieces (14) are curved in the shape of arc so that they are widened with tension to accommodate the body (23) of the writing pen (20) therebetween and they are recovered when the body (23) is pulled out.

When the user needs to take notes and pulls out the body (23) of the writing pen (20) from the locking pieces (14), the locking pieces (14) get wider again outwardly so that the body (23) can be pulled out by force.

Therefore, while the user is operating the keyboard of the computer, the connecting parts (12) of the holder (10) are coupled with each other on the back of the user's hand, and the body (23) of the writing pen (20) is fitted into the locking pieces (14). On the other hand, when writing is necessary, the body (23) of the writing pen (20) is pulled out from the locking pieces (14) so that the user can take notes holding the body (23) in his hand.

When the writing is finished, the body (23) of the writing pen (20) is returned again toward the free space between the locking pieces (14) to be fitted thereto and is returned to its initial state.

The writing member (22) at the other end of the writing pen (20) can be provided with a protection cap (24) for a ball-point pen, sign pen and the like.

On the other side of the contact part (11) which is in contact with the palm of the user 's hand, a plurality of protrusions for osteopathy (19) can be provided so that the user can be treated with osteopathy.

As shown in FIG. 3, a plurality of protrusions for osteopathy (19) are formed on one side of the contact part (11) which is in close contact with the palm of the user, and thus while the user wears the holder (10), the user can be treated with osteopathy and the user's health can be improved.

The protrusions (19) are not limited in a certain shape but include all the protruding shapes to perform osteopathy.

The present invention has many advantages as follows:

When it is necessary to take notes simultaneously with operating a keyboard of a computer, according to the present invention, the body of the writing pen is simply pulled out from the locking pieces of the holder with the fitting ball being pivoted in the spherical groove. The body of the writing pen is then held by the user to serve to take notes.

Then, when the writing is finished, the user can simply force the body of the writing pen to fit into the locking pieces of the contact part and have the writing pen be attached to the contact part of the holder which is not in contact with the user's palm.

As the writing pen can be conveniently fixed in and pulled out from the holder, the user can simultaneously take notes and operate a keyboard, and thus working efficiency can be improved.

It will be apparent to those skilled in the art that various modifications and variations can be made to the present invention without departing from the spirit and scope of the invention. The present invention covers the modifications and variations thereof provided they come within the scope of the appended claims and their equivalents.

What is claimed is:

1. A writing pen with a holder comprising:

a holder (10) of a predetermined width and length, having a contact part (11) in the center thereof to be in contact with a palm of a hand on one side; connecting parts (12) extending from both ends of the contact part (11) to be connected with each other on the back of the hand; a spherical groove for pivoting (13) formed at one end of the other side of the contact part (11); and locking pieces (14) formed at the other end of the other side of the contact part (11), and a writing pen (20) having a body (23); a fitting ball (21) formed at one end of the body (23) to be pivotable in the spherical groove (13); and a writing member (22) formed at the other end of the body (23).

2. The writing pen with a holder as claimed in claim 1, wherein one of the connecting parts (12) has a plurality of fitting holes (15) arranged in a predetermined interval at the end, and the other connecting-part (12) includes a protrusion (16) at the end thereof to be fitted into one of the fitting holes (15).

3. The writing pen with a holder as claimed in claim 1, wherein a plurality of protrusions for osteopathy (19) are provided on one side of the contact part (11) which is in contact with the palm of the user.

* * * * *